United States Patent [19]

Reinshagen

[11] Patent Number: 4,662,939

[45] Date of Patent: May 5, 1987

[54] PROCESS AND COMPOSITION FOR IMPROVED CORROSION RESISTANCE

[75] Inventor: John H. Reinshagen, North Huntingdon, Pa.

[73] Assignee: Pfizer Inc., New York, N.Y.

[21] Appl. No.: 832,292

[22] Filed: Feb. 21, 1986

[51] Int. Cl.[4] ..... B22F 1/00

[52] U.S. Cl. ..... 75/246; 75/247; 75/255; 419/23; 419/38; 420/92

[58] Field of Search ..... 75/228, 246, 247, 123 A, 75/123 K, 255; 419/38, 23

[56] References Cited

U.S. PATENT DOCUMENTS 3,425,813 2/1969 Orlemann ..... 29/183.5
3,520,680 7/1970 Orlemann ..... 75/212
4,314,849 2/1982 Ro et al. ..... 75/228
4,331,478 5/1982 Ro et al. ..... 75/228
4,420,336 12/1983 Klar et al. ..... 75/246

*Primary Examiner*—Stephen J. Lechert, Jr.
*Attorney, Agent, or Firm*—Charles J. Knuth; Peter C. Richardson; Gezina Holtrust

[57] ABSTRACT

Corrosion resistance of stainless steel powder moldings is improved by combining the powder before molding with about 8 to 16% by weight of an additive consisting essentially of about 2 to 30% by weight of tin and 98 to 70% by weight of copper and/or nickel. Stainless steel moldings are prepared by compacting the powder at high pressure and heating to sintering temperature.

22 Claims, No Drawings

PROCESS AND COMPOSITION FOR IMPROVED CORROSION RESISTANCE

BACKGROUND OF THE INVENTION

The invention relates to a process and composition for improving corrosion resistance of stainless steel powder moldings by combining said powder before molding with a metal additive.

U.S. Pat. Nos. 3,425,813 and 3,520,680 are concerned with improving corrosion resistance of stainless steel powder moldings by coating or blending the stainless steel powder before molding with very small amounts of a metal additive consisting of tin or a tin alloy with nickel or copper. Improved corrosion resistance is attained when compacting the coated powders and sintering them at between 2000° and 2300° F.

Further improvement in corrosion resistance is obtained with the composition and method of the invention as described below employing larger amounts of at least one of copper or nickel.

SUMMARY OF THE INVENTION

The invention provides a process for improving the corrosion resistance of stainless steel powder moldings by combining said powder before molding with about 8 to 16% by weight of an additive consisting essentially of by weight 2 to 30% of tin and 98 to 70% of at least one metal selected from the group consisting of copper and nickel.

The invention includes a process for preparing stainless steel moldings of enhanced corrosion resistance by combining stainless steel powder with about 8 to 16% by weight of an additive consisting essentially of by weight 2 to 30% of tin and 98 to 70% of at least one metal selected from copper and nickel, compacting said combined powder at high pressure, and heating the formed compact to sintering temperature.

The invention further includes a molding composition comprising stainless steel powder and about 8 to 16% by weight of an additive consisting essentially of by weight 2 to 30% of tin and 98 to 70% of at least one metal selected from copper and nickel, and a product comprising a pressed, sintered molding composition of a stainless steel powder and about 8 to 16% by weight of an additive consisting essentially of by weight 2 to 30% of tin and 98 to 70% of at least one metal selected from copper and nickel.

In each of the above embodiments of the invention, the additive may conveniently comprise by weight about 4 to 13% tin, about 5 to 20% nickel, and the balance copper, or, preferably, about 4 to 8% tin, about 6 to 15% nickel, and the balance copper, more specifically about 8% tin, about 15% nickel and about 77% copper, or about 4.5% tin, about 7.5% nickel and about 88% copper.

The additive is conveniently blended in particulate form with the stainless steel powder. The size of the particles of the additive is preferably 500 mesh (25 micron) or finer.

The invention is particularly effective in improving corrosion resistance against sulfuric acid in concentrations of up to about 30% by weight, specifically about 10 to 20% by weight of sulfuric acid.

DETAILED DESCRIPTION OF THE INVENTION

The stainless steel powder may be combined with the additive by different conventional methods. Conveniently, the stainless steel powder is blended with the additive. Alternatively, the stainless steel powder may be coated with the additive as described in U.S. Pat. Nos. 3,425,813 and 3,520,680 which are incorporated herein by reference.

The blending procedure is generally the simplest one. This procedure has the advantage that during the sintering step to produce the stainless steel moldings the stainless steel powder particles first sinter together at points where they are in intimate contact with each other to form strong stainless steel to stainless steel bonds. On coating the stainless steel particles with the additive, the coatings generally inhibit this intimate stainless steel to stainless steel contact, thus resulting in bonds which are not as strong.

The additive is preferably an alloy of tin with at least one of copper or nickel, although the metals may be added separately, e.g. one at a time or in a physical blend. The alloy additive has the advantage of a melting point that is considerably above the melting point of the unalloyed tin. If the alloy additive is used, some stainless steel to stainless steel sintering may occur during sintering before liquification of the additive resulting in enhanced strength and minimal distortion of the sintered product. The alloy additive is preferably in particulate form to attain even distribution when combining the stainless steel powder and the additive. In general, finer particles are desirable since a more uniform distribution will result. One suitable method for obtaining fine alloy particles is by water atomization, although other conventional methods may be used.

The novel powder-additive mixture is useful in molding. Moldings may be made by various known techniques for converting metal powders into coherent aggregates by application of pressure and/or heat. Such techniques include powder rolling, metal powder injection molding, compacting, isostatic pressing and sintering.

It is generally desirable to add a small quantity of lubricant to the molding composition to protect the dies and to facilitate removal of the compacted specimen. Usually, about 0.25–1% of lubricant is added. Typical lubricants are lithium stearate, zinc stearate, and Acrawax C or other waxes.

According to a preferred method, the powder-additive mixture is compacted and sintered by conventional powder metallurgy procedures. The powder-additive mixture is compacted at high pressure in a mold of desired shape, usually at room temperature and about 5 to 50 tons per square inch pressure.

After compacting, the product is removed from the mold and heated to remove the lubricant. The heating step is generally at about 800° to 1000° F. for about 15 minutes to about an hour. The product is then sintered at about 2000° to 2300° F. for about 15 minutes to about an hour.

It is generally known that the corrosion resistance of the final sintered molding is affected by the lubricant removal and sintering steps. Reactions may occur between the moldings and residual lubricant or the sintering atmosphere, particularly in view of the large surface area of the pores in powder metallurgy stainless steel moldings.

If lubricant removal is inadequate or the sintering atmosphere is contaminated with carbon, the carbon content of the molding increases and sensitization, and the associated loss of corrosion resistance, may occur during cooling after sintering. Sensitization may be minimized by rapid cooling after sintering.

The corrosion resistance of stainless steel moldings generally decreases with increasing oxygen content of the sintering atmosphere. This reduction in corrosion resistance may be due to chromium oxide formation and the associated chromium depletion of the surrounding matrix. Whatever the mechanism, furnace dewpoint control is important. The dewpoint should be such that oxygen in the molding is reduced during sintering in a reducing atmosphere. Since an atmosphere with an adequate dewpoint at the sintering temperature becomes oxidizing at a lower temperature during cooling, rapid cooling after sintering is preferred.

Sintering in a nitrogen containing atmosphere may increase the nitrogen content of the molding resulting in chromium nitride precipitation and chromium depletion during cooling after sintering. Chromium depletion generally causes reduction of corrosion resistance. Although this problem could be avoided by sintering in non-nitrogen containing atmospheres such as pure hydrogen or vacuum, for economic reasons most commercial sintering is in dissociated ammonia. Sintering in nitrogen containing atmospheres is preferably at higher sintering temperatures, since the solubility of nitrogen in the metal molding generally decreases with increasing temperatures in the range of sintering temperatures generally employed. Rapid cooling after sintering is preferred to minimize nitrogen absorption and chromium nitride precipitation.

During sintering, the product shrinks and densifies. A high density material may be obtained, for instance having a density of at least about 80% of theoretical density, by increasing the pressure during compacting, sintering at higher temperatures or for longer periods of time, etc. Usually, the maximum density obtained is a density of about 86% of theoretical density. In the above, it is assumed that a material of 100% of theoretical density has a density of 8.0 g/cm$^3$. A low density material may be obtained at lower compacting pressure, lower sintering temperatures, etc. Such low density material may be used in porous filters.

The stainless steel powders that may be used include the austenitic chromium- nickel- iron AISI 300 Series stainless steels, such as Types 304L and 316L, as well as the martensitic AISI 400 Series chrome irons. The powders usually have at least 90% by weight of particles finer than 100 mesh, U.S. Standard Sieve size, and generally 10 to 60% by weight finer than 325 mesh.

The produced sintered moldings may be utilized for many applications such as bushings, cams, fasteners, gears, nuts, porous filters and terminals, where enhanced corrosion resistance is desired.

The following examples are provided to illustrate the invention and should not be construed as limiting the invention, the scope of which is indicated by the appended claims.

EXAMPLE 1

An alloy powder additive of 8% tin, 15% nickel and 77% copper obtained by water atomization was blended with 316L and 304L stainless steel powder also obtained by water atomization and 1% by weight lithium stearate lubricant. The additive was employed at levels from 0 to 20% by weight of the total composition using a size distribution of −500 (25 micron) U.S. Standard Sieze mesh size, as set out in Tables I and II.

The above blend was compacted in the form of Metal Powder Industries Federation (MPIF) Transverse Rupture Strength (TRS) test specimens. The samples obtained were compacted to a green density of 6.65±0.05 g/cm$^3$.

The lubricant was removed by heating the green compacts in a laboratory muffle furnace for 30 minutes at 950° F. in simulated dissociated ammonia (DA) in accordance with conventional powder metallurgy practice.

After lubricant removal, the 316L samples were sintered for 60 minutes at 2050° F. and the 304L samples were sintered for 40 minutes at 2050° F. or 2200° F., in simulated DA in a laboratory muffle surface, then transferred to the water-cooled zone of the furnace and allowed to cool to room temperature.

The densities of the sintered samples were determined by standard MPIF procedures.

The samples were tested for corrosion resistance by partial immersion (about half the length of the sample at room temperature in a solution of 5% sodium chloride in deionized water. A single sample was tested for each combination of stainless steel, additive level and sintering temperature.

Corrosion resistance was measured by determining the time required for test samples to exhibit the first visible signs of corrosion (rust).

Table I presents the test results for 316L stainless steel. The sample without additive and the sample having 4% additive exhibited corrosion very rapidly. The sample having 8% additive had a strikingly improved corrosion resistance.

Table II presents the test results for 304L stainless steel. The samples without the additive exhibited corrosion very rapidly. The samples with 4% additive had slightly improved corrosion resistance. At additive levels of 8% or more, superior corrosion resistance was obtained.

In both Tables I and II additive levels of 16% or more showed decreasing corrosion resistance.

TABLE I

| 316L Stainless Steel Sintered for 60 Minutes at 2050° F. | | |
|---|---|---|
| Additive Amount (%) | Density (g/cm$^3$) | Time to Exhibit First Corrosion (hours) |
| 0 | 6.71 | 1 |
| 4 | 6.46 | 1 |
| 8 | 6.46 | 992 |
| 12 | 6.50 | 992 |
| 16 | 6.53 | 700 |
| 20 | 6.57 | 700 |

TABLE II

| 304L Stainless Steel | | | | |
|---|---|---|---|---|
| | Sintered for 40 min. at 2050° F. | | Sintered for 40 min. at 2200° F. | |
| Additive Amount (%) | Density (g/cm$^3$) | Time to Exhibit First Corrosion (hrs) | Density (g/cm$^3$) | Time to Exhibit First Corrosion (hrs) |
| 0 | 6.74 | 2 | 6.89 | 2 |
| 4 | 6.56 | 5 | 6.55 | 48 |
| 8 | 6.34 | 360 | 6.32 | 336 |
| 12 | 6.44 | 865 | 6.45 | 480 |
| 16 | 6.55 | 384 | 6.57 | 384 |

EXAMPLE 2

An alloy powder additive of 8% tin, 15% nickel and 77% copper, obtained by water atomization, was blended with 316L and 304L stainless steel powder also obtained by water atomization and 1% by weight lithium stearate lubricant. The additive was employed at levels of 0% and 10% by weight of the total composition, using −500 (25 micron) U.S. standard sieve mesh size distribution.

The above blend was compacted in the form of MPIF TRS test specimens. The samples obtained were compacted to a green density of 6.65±0.05 g/cm$^3$.

The lubricant was removed by heating the green compacts for 30 minutes at 950° F. in air.

After lubricant removal the samples were sintered for 40 minutes at 2050° F. in simulated DA in a laboratory muffle furnace, then transferred to the water-cooled zone of the furnace and allowed to cool to room temperature, and weighed.

The samples were tested for corrosion resistance by total immersion at room temperature in solutions of 10% and 20% sulfuric acid. Six samples were tested for each combination of stainless steel, additive level and sulfuric acid concentration. All samples were tested simultaneously, and a single sample from each combination was removed and evaluated after set time intervals, as indicated in Tables III and IV. The samples were examined upon removal, then rinsed, thoroughly dried and weighed.

Corrosion resistance was determined by the weight changes exhibited by the samples, and by the appearance of the samples following testing.

The results for 316L are presented in Table III, and those for 304L in Table IV. The samples without additive experienced severe attack, as indicated by the large weight losses, while those with the additive showed little weight change, illustrating their excellent corrosion resistance. Visual examination of the samples with additive revealed them to be virtually free from tarnish, while the samples without additive had a heavily attacked and corroded appearance.

TABLE III

| | 316L Stainless Steel | | | |
|---|---|---|---|---|
| | Weight Change in 10% $H_2SO_4$ (%) | | Weight Change in 20% $H_2SO_4$ (%) | |
| Test Duration (Hours) | No Additive | 10% Additive | No Additive | 10% Additive |
| 24 | −1.6 | +0.3 | −14 | +0.5 |
| 48 | −3.2 | +0.2 | −20 | +0.5 |
| 96 | −4.8 | +0.2 | −19 | +0.4 |
| 192 | −7.8 | +0.1 | −22 | +0.3 |
| 272 | −8.6 | +0.1 | −22 | +0.3 |
| 384 | −11.8 | 0 | −24 | +0.2 |

TABLE IV

| | 304L Stainless Steel | | | |
|---|---|---|---|---|
| | Weight Change in 10% $H_2SO_4$ (%) | | Weight Change in 20% $H_2SO_4$ (%) | |
| Test Duration (Hours) | No Additive | 10% Additive | No Additive | 10% Additive |
| 24 | −14 | +0.2 | −14 | +0.2 |
| 48 | −23 | −0.2 | −24 | +0.1 |
| 96 | −26 | −0.4 | −24 | −0.1 |
| 192 | −32 | −0.6 | −25 | +0.2 |
| 272 | −33 | −0.7 | −28 | 0 |
| 384 | −33 | −0.7 | −32 | −0.3 |

I claim:

1. A process for improving the corrosion resistance of stainless steel powder moldings which comprises blending said powder before molding with about 8 to 16% by weight of an additive in particulate form consisting essentially of by weight 2 to 30% of tin and 98 to 70% of at least one element selected from copper and nickel.

2. A process according to claim 1 wherein said additive comprises by weight about 4 to 13% tin, about 5 to 20% nickel, and the balance copper.

3. A process according to claim 1, wherein said additive comprises by weight about 4 to 8% tin, about 6 to 15% nickel, and the balance copper.

4. A process according to claim 1 wherein said additive comprises by weight about 8% tin, about 15% nickel and about 77% copper.

5. A process according to claim 1 wherein said additive comprises by weight about 4.5% tin, about 7.5% nickel and about 88% copper.

6. A process according to claim 1 wherein said additive particles have a size of about 500 mesh or finer.

7. A process according to claim 4 wherein said additive is comprised of particles having a size of 500 mesh or finer.

8. A process according to claim 1 wherein said stainless steel is stainless steel 316L.

9. A process according to claim 1 wherein said stainless steel is stainless steel 304L.

10. A process for preparing stainless steel moldings of enhanced corrosion resistance which comprises blending stainless steel powder with about 8 to 16% by weight of an additive in particular form essentially consisting of by weight 2 to 30% of tin and 98 to 70% of at least one metal selected from copper and nickel, compacting said combined powder at high pressure, and heating said compact to sintering temperature.

11. A process according to claim 10 wherein said additive is blended in particulate form with said stainless steel powder.

12. A process according to claim 10 wherein said stainless steel is stainless steel 316L.

13. A process according to claim 10 wherein said stainless steel is stainless steel 304L.

14. A process according to claim 10 wherein said additive comprises by weight about 4 to 13% tin, about 5 to 20% nickel, and the balance copper.

15. A process according to claim 10 wherein said additive comprises by weight about 4 to 8% tin, about 6 to 15% nickel, and the balance copper.

16. A process according to claim 10 wherein said additive comprises by weight about 8% tin, about 15% nickel and about 77% copper.

17. A process according to claim 16 wherein said additive is comprised of particles having a size of 500 mesh or finer.

18. A process according to claim 10 wherein said additive comprises by weight about 4.5% tin, about 7.5% nickel and about 88% copper.

19. A molding composition comprising stainless steel powder and about 8 to 16% by weight of an additive in particulate form essentially consisting of by weight 2 to 30% tin and 98 to 70% of at least one metal selected from copper and nickel.

20. A product having improved corrosion resistance to sulfuric acid of up to about 30% by weight comprising a pressed, sintered composition of a stainless steel powder and about 8 to 16% by weight of an additive in particulate form essentially consisting of by weight 2 to 30% tin and 98 to 70% of at least one metal selected from copper and nickel.

21. A product according to claim 20 wherein said additive comprises by weight about 4 to 8% tin, about 6 to 15% nickel, and the balance copper.

22. A product according to claim 21 wherein said stainless steel is at least one of stainless steel 316L and 304L.

* * * * *